United States Patent [19]

Tooka

[11] Patent Number: 4,563,873

[45] Date of Patent: Jan. 14, 1986

[54] APPARATUS FOR CONTROLLING PRODUCTION IN A SPINNING MACHINE

[75] Inventor: Takuzo Tooka, Toyoake, Japan

[73] Assignee: Kabushiki Kaisha Toyoda Jidoshokki Seisakusho, Kariya, Japan

[21] Appl. No.: 543,256

[22] Filed: Oct. 19, 1983

[30] Foreign Application Priority Data

Oct. 21, 1982 [JP] Japan ..... 57-185298

[51] Int. Cl.[4] ..... D01H 13/24; D01H 9/14

[52] U.S. Cl. ..... 57/264; 57/265; 57/276; 57/400

[58] Field of Search ..... 57/263, 264, 265, 266, 57/276, 268; 242/39, 36

[56] References Cited

U.S. PATENT DOCUMENTS

| | | | |
|---|---|---|---|
| 3,877,209 | 4/1975 | Seidl et al. | 57/404 X |
| 3,988,879 | 11/1976 | Franzolini | 242/39 X |
| 4,019,310 | 4/1977 | Seidl et al. | 57/265 |
| 4,078,369 | 3/1978 | Brandis | 57/265 |
| 4,178,748 | 12/1979 | Stahlecker et al. | 57/268 X |
| 4,194,349 | 3/1980 | Lane | 57/265 |

FOREIGN PATENT DOCUMENTS

| | | | |
|---|---|---|---|
| 47723 | 3/1982 | European Pat. Off. | 57/264 |
| 131476 | 6/1978 | German Democratic Rep. | 57/265 |

*Primary Examiner*—Donald Watkins
*Assistant Examiner*—Joseph J. Hail, III
*Attorney, Agent, or Firm*—Brooks, Haidt, Haffner & Delahunty

[57] ABSTRACT

An apparatus for controlling production controlling in a spinning machine is disclosed herein. Sliver consumption quantity at each of the spinning stations is computed from the count of pulse signals generated in synchronism with the rotation of a drive shaft, e.g., of a winding drum, and from the count of those pulse signals generated in the same way but during yarn piecing or doffing operations when no spun yarn is wound. When a reference value of preset data is reached by the computed sliver consumption quantity with respect to any spinning station, a device is operated to give an alarm signaling the need for sliver can replacement with a full one at that station.

6 Claims, 2 Drawing Figures

APPARATUS FOR CONTROLLING PRODUCTION IN A SPINNING MACHINE

BACKGROUND OF THE INVENTION

The present invention relates to an apparatus for controlling production in a spinning machine, or more specifically it relates to an apparatus for providing an alarm signaling the need for replacement of a nearly empty sliver can with a new one full of sliver at a spinning station of a spinning machine, such as an open-end or fluid jet spinning machine, of the type wherein a strand of sliver is fed to each of the plurality of spinning units of said spinning machine.

According to a conventional procedure in a spinning machine, e.g. an open-end spinning frame, which comprises a plurality of individual working or spinning stations each having a can for holding therein a strand of sliver to be fed continuously to its associated spring unit, it has been the practice to have a workman check each of the sliver cans on a periodic basis to determine the remaining quantity of sliver and to replace an almost empty can, if any, with one full of a strand of new sliver so that the trailing end of the old sliver may be connected with the trailing end of the new one.

This procedure is disadvantageous, however, not only in that the operation by the workman is troublesome and time-consuming, but also that more workmen are necessary in a spinning mill having a number of spinning frame. Moreover, a decrease in installations productivity of each spinning machine results if any of its spinning stations is left in a non-productive state for a long period of time with its sliver can emptied.

An object of the present invention is therefore to remove the above disadvantage by providing an apparatus for controlling production which can relieve production personnel in a spinning mill from the trouble associated with sliver can replacement.

Another object of the invention is thus to contribute to labor saving in a spinning mill.

The above and other objects and advantages of the present invention will become more readily apparent to those skilled in the art from the following detailed description of a preferred embodiment of the invention, taken in conjunction with the accompanying drawings, wherein:

DETAILED DESCRIPTION OF PREFERRED EMBODIMENT

Figure 1:
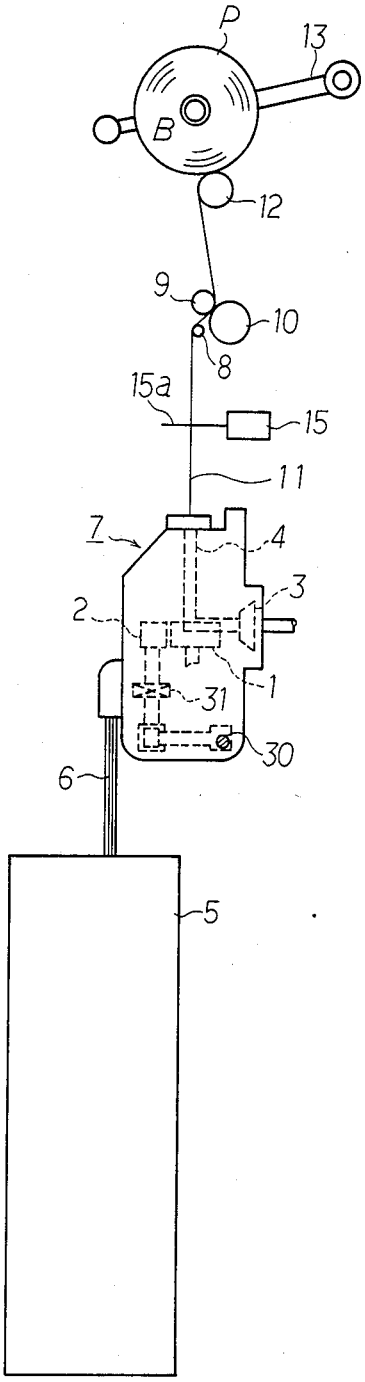
FIG. 1 is a schematic side elevation of a spinning station in an open-end spinning machine to which apparatus according to the invention may be applied.

As is well known, an open-end spinning machine generally comprises a plurality of spinning units, each of which defines a working or spinning station of the machine. A spinning station of an open-end spinning machine which is exemplified in FIG. 1 includes a spinning unit 7 having therein a combing roller 1, a feeding roller 2, a spinning rotor 3 and a yarn draw-off tube 4. The spinning station further includes a sliver can 5 arranged below the spinning unit 7 for holding a strand of sliver 6, a yarn guide 8, a yarn draw-off roller 10 paired with a pressure roller 9, and a winding drum 12, whose rotation is in common with all other drums 12 at the spinning stations on one side of the machine, for winding up the spun yarn 11 while traversing and distributing the same on a bobbin B to form a yarn package P in the shape of a cone or the like. The bobbin B is supported by a cradle arm 13 which may be pivoted and lifted by a lifting mechanism (not shown in FIG. 1, but indicated by the reference numeral 14 in the block diagram in FIG. 2) so as to lift the package P clear of the rotating winding drum 12 for stopping the winding of the spun yarn 11 on the package.

In addition, each spinning station includes a yarn sensor 15 as a means for detecting normal passage of the spun yarn 11, which is disposed in the shown embodiment between the spinning unit 7 and yarn guide 8 and adapted to detect a break in the spun yarn. The yarn sensor 15 has a feeler portion 15*a* which is in engagement with the spun yarn 11 during the normal spinning and winding operation and which energizes or turns ON the yarn sensor 15 when it is released from its engagement with the yarn, e.g., due to a break in the yarn, thus, the yarn sensor generates an ON signal. In the preferred embodiment of the invention, this yarn sensor 15 is desirably so arranged that its feeler portion 15*a* is kept in the disengaged state, and said ON signal is effective while a doffing or bobbin changing operation is carried out by a doffer (not shown) which removes a full package holding a predetermined quantity or length of the spun yarn 11 and replaces it with an empty bobbin, and before again commencing the winding operation subsequent to such doffing. Furthermore, it is desirable according to the embodiment of the invention that each sliver can 5 in a full state should contain substantially a given quantity or length of sliver 6 therein.

Figure 2:
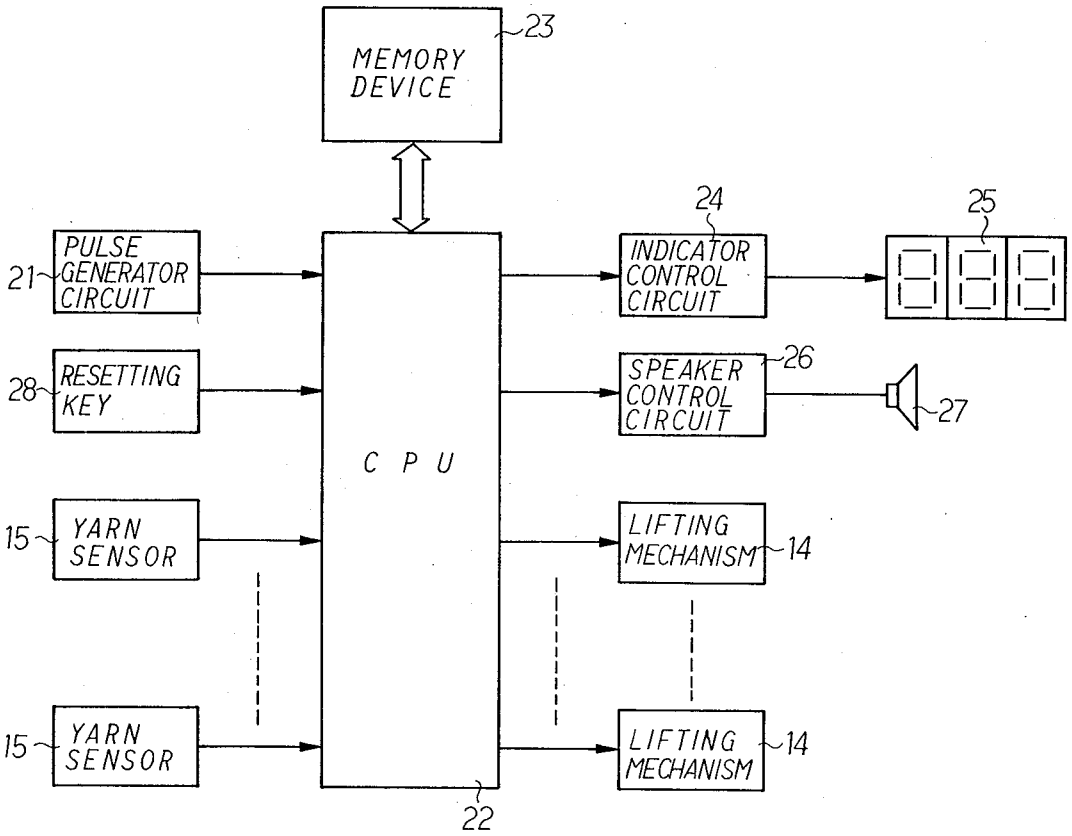
FIG. 2 is a schematic block diagram showing the apparatus of the invention.

An apparatus for controlling production independently at each of the spinning stations by computing the quantity of yarn windings and the quantity of sliver 6 consumed at the spinning station will now be explained with reference to the schematic block diagram shown in FIG. 2. This apparatus may be installed either in a centralized control room separate from the spinning machine or incorporated in the machine, e.g., at an end frame thereof.

The control apparatus includes a pulse generator circuit 21 which is operatively connected to a drive shaft (not shown) of the winding drum 12 and arranged so as to generate a pulse signal for each turn or rotation of the drive shaft which rotates integrally with the winding drum, each pulse signal corresponding to a unit length of the yarn 11 wound on a package by a single turn or rotation of the winding drum 12. The pulse signals thus cyclically generated by the circuit 21 are supplied as input signals to a central processing unit 22, which is abbreviated as CPU in FIG. 2, as a control circuit.

Each of the yarn sensors 15 provided at each of the spinning stations is operatively connected to the central processing unit 22 in such a way that the aforementioned ON signal generated by the yarn sensor, e.g., due to a break in the yarn 11 is transmitted to the unit 22, which the provides in response to said ON signal a lifting signal to the lifting mechanism of the corresponding spinning station so that its package P is lifted from the winding drum 12, and the winding operation at at that station is thereby stopped. By counting the number of the abovesaid cyclical pulse signals emitted by the pulse generator circuit 21 in synchronism with the rotation of the drive shaft of the winding drum 12, as well as the number of those pulse signals which are generated during the intervals of time elapsing from the moment of generation of said ON signal by the yarn sensor 15 until a normal spinning and winding operation is resumed after completion of yarn piecing by a yarn piecer (not shown) or of doffing by a doffer (not shown either), the central processing unit 22 counts the number of turns or rotations of the winding drum 12 and also the ineffective number of turns or rotations thereof, the latter corresponding to the number of rotations of the winding drum during the yarn piecing or doffing operation during which no spun yarn is wound up while the winding drum continues to rotate. The central processing unit 22 then subtracts the latter count from the former to figure out the current quantity of yarn windings on the package P at each of the spinning stations and also the current total quantity of yarn windings including those yarn windings on a package or packages, if any, which were formed previously from the same sliver 6. Based on said total quantity of yarn windings thus figured out, the central processing unit 22 computes the quantity of sliver 6 consumed until then.

The central processing unit 22 is connected with a memory device 23 which includes memory regions corresponding to the individual spinning stations of the spinning machine, each of said memory regions having three memory units for storing the current data of said yarn winding quantity on a package P then being formed, total yarn winding quantity, and sliver consumption quantity, respectively.

The memory device 23 has reference values of preset data stored therein independently of the abovesaid variable data, said values of preset data representing yarn winding quantity on a full package of a predetermined size or diameter, and sliver consumption quantity at which the sliver can 5 is nearly empty and therefore calls for replacement with one full of a strand of new sliver 6, respectively. The variable data of the yarn winding quantity on the package and of the sliver consumption quantity are compared by the central processing unit 22 with the above reference values of the preset data. When the reference value of the yarn winding on the package is reached by the variable data of the corresponding yarn winding quantity then stored in the memory unit, the central processing unit 22 supplies a lifting signal to the lifting mechanism of the relevant spinning station to stop its yarn winding operation, thereby permitting commencement of the doffing operation at that spinning station. Output of this lifting signal from the central processing unit 22 simultaneously stops the computing operation until the winding operation is resumed. Simultaneously upon starting the subsequent winding operation on a new bobbin B after doffing, the computing operation by the central processing unit 22 is resumed. It should be noted that prior to the resumption of the computing, the data of the yarn winding quantity of the previous package is cleared from its memory, but added to the data of total yarn winding quantity.

On the other hand, when the sliver 6 in the can 5 is reduced by consumption thereof to the extent of the reference value of the preset data of sliver consumption quantity, or when the sliver can 5 becomes almost empty, the central processing unit 22 generates in response thereto an indicating signal and simultaneously a warning signal, and these signals are supplied as input signals to an indicator control circuit 24 and speaker control circuit 26, respectively. In response to the indicating signal, the indicator control circuit 24 operates on the subsequent indicator unit 25 to indicate the number which represents the sliver can 5 of the spinning station in question. The speaker control circuit 25 to which the warning signal is provided energizes a speaker 27 as a warning or alarming means.

A resetting key 28 connected to the central processing unit 22 is used when the nearly empty sliver can 5 is replaced with a new one with a full charge of sliver 6. When this key is depressed, the data of total yarn winding quantity in the memory corresponding to the relevant spinning station is cleared or reset to permit commencement of computing the sliver consumption quantity at that station.

The manner in which the embodiment of the apparatus thus constructed operates will be now described in the following.

In normal spinning operation, a strand of spun yarn 11 withdrawn from the spinning unit 7 and passed over the yarn guide 8 is drawn by the draw-off roller 10 in conjunction with its paired pressure roller 9 and then wound up on the bobbin B by the winding drum 12 into the yarn package P, as shown in FIG. 1. During such normal spinning operation, pulse signals are generated cyclically by the pulse generator circuit 21 in synchronism with the rotation of the winding drum 12 and supplied as input signals to the central processing unit 22. In the event of a yarn break for any reason, the yarn sensor 15 is operated thereby to transmit an ON signal to the unit 22, and a yarn piecing operation is performed to repair the yarn break, during which said ON signal remains effective.

As the yarn winding operation thus continues with interruptions thereof due to yarn breaks, the central processing unit 22 computes the yarn winding quantity on the package P, total yarn winding quantity and sliver consumption quantity on the basis of the count of the cyclical pulse signals and the count of ineffective pulse signals generated while the ON signal is effective during the yarn piecing, and the computed data of these quantities are stored in the relevant memory region in the memory device 23. When the yarn winding quantity on the package P is increased to the reference value of the corresponding preset data, the central processing unit 22 provide a lifting signal to the lifting mechanism 14. Accordingly, the lifting mechanism 14 is operated to lift the cradle arm 13 so that the package P in contact with the winding drum 12 is disengaged and therefore winding of the yarn is stopped. Thereafter, a doffing operation is performed to replace the full package P with an empty bobbin. In this way, a package P having a given length of yarn windings is produced.

After the doffing operation is over, a new strand of yarn 11 is spun out and wound up on a new bobbin B. At least before the commencement of winding of the new strand of yarn, the data of yarn winding quantity on the previous bobbin, stored in the memory device 23, is cleared. Simultaneously with the commencement of the subsequent winding, the yarn winding quantity is computed by the central processing unit 22 and stored in the memory device in the way mentioned earlier.

Such yarn winding to form a full package is repeated until the sliver consumption quantity stored in the memory device 23 is increased to reach the reference value of preset data of sliver consumption quantity at which sliver can replacement is called for, or until just before the sliver can 5 becomes nearly empty. Then, the central processing unit 22 supplies an indicating signal to the indicator control circuit 24 and a warning signal to the speaker control circuit 26, thereby indicating on the indicator 25 the number of the sliver can 5 which is about to be emptied and simultaneously constituting an alarm by energizing the speaker 27. Thus, the indicator 25 and speaker 27 help the production personnel to immediately recognize the nearly empty sliver can which needs to be replaced with a new can full of a given quantity of sliver 6.

As it is now apparent from the foregoing, the use of the above embodiment of production controlling apparatus according to the present invention allows the production personnel to be informed of the sliver can which calls for its replacement with a full one by means of the above-described indicator 25 and speaker 27 as an alarm without the trouble of walking around the spinning machine for inspection of their sliver cans for their remaining quantities of sliver therein, thus contributing greatly to laborsaving in controlling production in a spinning mill.

While the invention has been illustrated and described with reference to a preferred embodiment thereof, it is to be understood that various changes in the details may be made without departing from the spirit and scope of the invention, for example;

(1) Lifting mechanism 14 does not have to be operated substantially simultaneously with the provision of a yarn-break signal or full-package signal, but it may be provided on a yarn piecer or doffer so that the lifting operation may be performed at any convenient time prior to the yarn piecing or doffing operation.

(2) The pulse generator circuit 21 for cyclically generating the pulse signals may be connected to a drive shaft of the draw-off roller 10.

(3) Instead of a yarn sensor 15 which is adapted specifically to detect a yarn break, a yarn sensor to detect passage of a spun yarn may be provided at any point in the yarn passageway so that an ON signal may be emitted thereby in the event of a yarn break or when doffing is to be performed.

(4) In the spinning unit 7 including a clutch 31 which is provided between the feed roller 2 and its driving shaft 30 and energizable so as to stop the feed roller for interrupting the supply of sliver, a signal for energizing the clutch 31 for disengagement thereof may function simultaneously as said ON signal for actuating the lifting mechanism 14 to lift the cradle arm 13.

(5) There may be provided at each of the spinning stations a counter for measuring yarn winding quantity in the package P by counting the pulse signals generated by the pulse generator circuit and a counter for determining sliver consumption quantity, which counters are stopped while an ON signal is coming from a yarn passage sensor for computing the actual yarn winding and sliver consumption quantities.

I claim:

1. An apparatus for controlling production in a spinning machine having a plurality of spinning stations each having a sliver can thereat, comprising:

a pulse generating circuit for generating pulse signals cyclically in synchronization with the yarn spinning operation at each of said spinning stations, each pulse signal corresponding to a unit length of yarn spun at any one of said spinning stations;

detecting means at each of said spinning stations for detecting normal passage of said yarn spun at the station, said detecting means being energized by the absence of said spun yarn to provide a detector signal when, and for the period during which the yarn is absent in its normal course of passage at the station;

respective warning means for each said station; and control circuit means comprising a memory for storing a preset limit on the quantity of sliver consumption at each said spinning station, said limit substantially corresponding to the sliver capacity of said sliver can at the station, and central processing means connected to said pulse generating circuit and to each of said detecting means for receiving said pulse signals and said detector signals therefrom, said central processing means having means for computing the actual quantity of sliver consumption at each said spinning station by counting said pulse signals and, for each said station, respectively, subtracting from said count the number of pulse signals generated during each said time period when said detector signals are received from said detecting means at the station, said control circuit further having means providing a signal for energizing that one of said warning means associated with any one of said spinning stations when said computed sliver consumption at said one station attains said preset limit for the station.

2. An apparatus according to claim 1, wherein said pulse signals are generated in synchronism with the rotation of a winding drum which is provided common to all the spinning stations on one side of the spinning machine.

3. An apparatus according to claim 1, wherein said pulse signals are generated in synchronism with the rotation of a yarn draw-off roller which is provided at each of the spinning stations.

4. An apparatus according to claim 1, which further comprises drive means for said spinning machine, and wherein each said spinning station comprises a yarn winding drum rotatable by said drive means, yarn bobbin means for mounting a bobbin on which said spun yarn is wound, means mounting said bobbin means for movement toward and away from said winding drum whereby yarn is wound on said bobbin by rotation of said drum when said bobbin is moved toward, and substantially engages said drum, and actuatable lifting means for lifting said bobbin mounting means whereby said bobbin is moved away from said drum to terminate its said rotation; said control circuit further comprises a memory for storing a preset limit on the quantity of yarn wound on each said bobbin; and said central processing means further has means for computing the actual quantity of yarn wound on each said bobbin by counting said pulse signals and, for each station, respectively, subtracting from said count the number of pulse signals generated during each said time period when said detector signals are received from said detecting means at the station; and means for actuating said lifting means associated with any one of said bobbins to so lift said bobbin mounting means and thereby terminate rotation of the bobbin when said computed yarn quantity attains said preset limit on yarn quantity for the bobbin, said detecting means at each said station also being energized by said lifting means actuation to provide said detector signal to said central processing means during each period while said bobbin rotation is terminated at the station.

5. A method for determining when any one of a plurality of sliver cans has been substantially emptied, the respective of said sliver cans being at, and holding a predetermined quantity of sliver being fed to respective ones of a plurality of spinning stations for spinning yarn therefrom on a spinning machine, comprising the steps of continuously generating cyclical pulse signals synchronized with the yarn spinning operation at each of said spinning stations representative of sequential unit lengths of the yarn being spun, continuously counting said pulse signals, detecting any period during which yarn is not being spun at each of said spinning stations, respectively, and for each said spinning station subtracting from said pulse signals being counted the number of said pulse signals counted during such period to thereby determine a total of said pulse signals representative of the actual quantity of yarn spun at said spinning station within a predetermined time period, comparing said total of said pulse signals for each said spinning station with a predetermined number of pulse signals representative of substantially said predetermined quantity of sliver in each said sliver can, and generating a warning signal indicating for each said spinning station, respectively, when said total of said pulse signals for that spinning station has attained said predetermined number of pulse signals, thereby warning when said sliver can at that spinning station is substantially emptied of said sliver.

6. A method according to claim 5, which further comprises comparing said total of said pulse signals for each said spinning station with a second predetermined number of pulse signals representative of a desired quantity of spun yarn on a bobbin at any one of said spinning stations, and changing the bobbin at each said spinning station, respectively, when said total of said pulse signals for that spinning station has attained said second predetermined number, said detecting for any said spinning station including any period during which said changing of a bobbin is performed thereat.

* * * * *